US011002413B2

(12) United States Patent
Fu

(10) Patent No.: US 11,002,413 B2
(45) Date of Patent: May 11, 2021

(54) LIGHT BULB APPARATUS

(71) Applicant: XIAMEN ECO LIGHTING CO. LTD., Xiamen (CN)

(72) Inventor: Mingyan Fu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/860,335

(22) Filed: Apr. 28, 2020

(65) Prior Publication Data

US 2020/0370711 A1 Nov. 26, 2020

(30) Foreign Application Priority Data

May 24, 2019 (CN) ..... 201920758406.4

(51) Int. Cl.

| | |
|---|---|
| ***F21K 9/237*** | (2016.01) |
| ***F21K 9/64*** | (2016.01) |
| ***F21K 9/232*** | (2016.01) |
| ***F21K 9/66*** | (2016.01) |
| ***F21V 29/70*** | (2015.01) |
| *F21Y 115/10* | (2016.01) |

(52) U.S. Cl.

CPC ..... *F21K 9/237* (2016.08); *F21K 9/232* (2016.08); *F21K 9/64* (2016.08); *F21K 9/66* (2016.08); *F21V 29/70* (2015.01); *F21Y 2115/10* (2016.08)

(58) Field of Classification Search

CPC ..... F21K 9/23–238

See application file for complete search history.

(56) References Cited

U.S. PATENT DOCUMENTS

2012/0206921 A1* 8/2012 Chang ..... F21K 9/232 362/311.02

* cited by examiner

*Primary Examiner* — Sean P Gramling

(74) *Attorney, Agent, or Firm* — Chun-Ming Shih; Lanway IPR Services

(57) ABSTRACT

A light bulb apparatus includes a bulb shell, a bulb head and a light source module. The bulb shell has a light passing portion and a neck portion. The neck portion has a first protruding ring, a first gap ring and a second protruding ring. The bulb head has a body portion and a cap portion. The neck portion has a third protruding ring, a second gap ring and a fourth protruding ring. The first protruding ring is placed in a second concave structure, the fourth protruding ring is placed in a first concave structure. The light source module is enclosed by the bulb shell and emitting light passing through the light passing cover of the bulb shell.

19 Claims, 10 Drawing Sheets

LIGHT BULB APPARATUS

FIELD

The present application is related to a light bulb apparatus and more particularly related to a light bulb apparatus with easy assembly.

BACKGROUND

Electroluminescence, an optical and electrical phenomenon, was discovered in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

It is also important to consider how to conveniently install a lighting apparatus. Particularly, many societies face aging problems. More and more old people need to replace or install lighting devices by themselves. Labor cost for installing lighting devices is also increasing. It is therefore beneficial to design a better way to install various lighting devices.

In some applications, it is important to project a light on an object or an area to emphasize the object or the area.

Light bulbs are widely used since Edison released his light bulbs. Today, more and more light bulbs use LED modules as light sources. There are many problems to solve and advantages to discover when converting to LED technology to design light bulbs.

It is challenging and beneficial to design a better light bulb with easier assembly and lower manufacturing cost.

SUMMARY

In some embodiments, A light bulb apparatus includes a bulb shell, a bulb head and a light source.

The bulb shell has a light passing portion and a neck portion. The neck portion has a first protruding ring, first gap ring and a second protruding ring. The first gap ring is located between the first protruding ring and the second protruding ring and forming a first concave structure with respect to the first protruding ring and the second protruding ring.

The bulb head has a body portion and a cap portion. The body portion has a third protruding ring, a second gap ring and a fourth protruding ring. The second gap ring is located between the third protruding ring and the fourth protruding ring and forms a second concave structure with respect to the third protruding ring and the fourth protruding ring. The cap potion is connected to a power socket for receiving an external power source. The first protruding ring is placed in the second concave structure. The fourth protruding ring is placed in the first concave structure.

A light source module is enclosed by the bulb shell and emitting light passing through the light passing cover of the bulb shell.

In some embodiments, the first protruding ring is a first closed ring, the second protruding ring includes multiple first protruding blocks, there are first gap areas between adjacent first protruding blocks.

In some embodiments, the third protruding ring is a second closed ring, the fourth protruding ring includes multiple second protruding blocks, there are second gap areas between adjacent second protruding blocks.

In some embodiments, the multiple first protruding blocks and the multiple second protruding blocks have smaller top portions than bottom portions, the top portions are protruding ends of the multiple first protruding blocks and the multiple second protruding blocks.

In some embodiments, the multiple first protruding blocks and the multiple second protruding blocks are trapezoid shape blocks.

In some embodiments, the multiple first protruding blocks and the multiple second protruding blocks are triangle blocks.

In some embodiments, the third protruding ring is engaged with the first protruding ring with interference fit connection. The first protruding ring is engaged with the fourth protruding ring with interference fit connection. The fourth protruding ring is engaged with the second protruding ring with interference fit connection.

In some embodiments, the neck portion has a bottom edge engaged with the third protruding ring with interference fit connection.

In some embodiments, the body portion of the bulb head includes an external layer and a heat sink layer, the heat sink layer surrounds the fourth protruding ring and the heat sink layer ends near and does not surround the third protruding ring.

In some embodiments, the connection of the bulb head and the bulb shell relies only by connection friction among the first protruding ring, the second protruding ring, the third protruding ring and the fourth protruding ring without using glue.

In some embodiments, a relative angle for fixing the bulb shell to the bulb head determines a setting used by a driver to control the light source module according to the setting.

During manufacturing, a setting is determined according to sales requirements. There are indicator marks on the bulb shell and the bulb head for guiding workers to fix the bulb head to the bulb shell with a relative angle corresponding to the determined setting.

In some embodiments, the setting includes a color temperature mixed by the light source module and is kept the same after the bulb shell is fixed to the bulb head.

In some embodiments, a heat insulation belt is disposed on a surface of the body portion for a user to remove the light bulb apparatus from the power socket.

In some embodiments, a heat insulation belt is disposed on a surface of the body portion for a user to remove the light bulb apparatus from the power socket.

In some embodiments, a bottom end of the bulb shell engages a heat sink disposed on the bulb head.

In some embodiments, the light passing cover has a blue light decreasing layer for decreasing blue light emitting outside the bulb shell.

In some embodiments, the blue light decreasing layer includes fluorescent material for converting a blue light to a non-blue light with a lower frequency than the blue light.

In some embodiments, the bulb shell is made of plastic material and deformed when using the bulb shell into the bulb heat to connect the first protruding ring and the second protruding ring.

In some embodiments, the body portion has a metal surrounding area and a non-metal surrounding area. A current conversion circuit is placed in the metal surrounding area and a wireless circuit is placed in the non-metal surrounding area.

In some embodiments, the metal surrounding area is rotatable with respect to the non-metal surrounding area for manually changing a setting used by a driver to control the light source module according to the setting.

DETAILED DESCRIPTION

Figure 8:
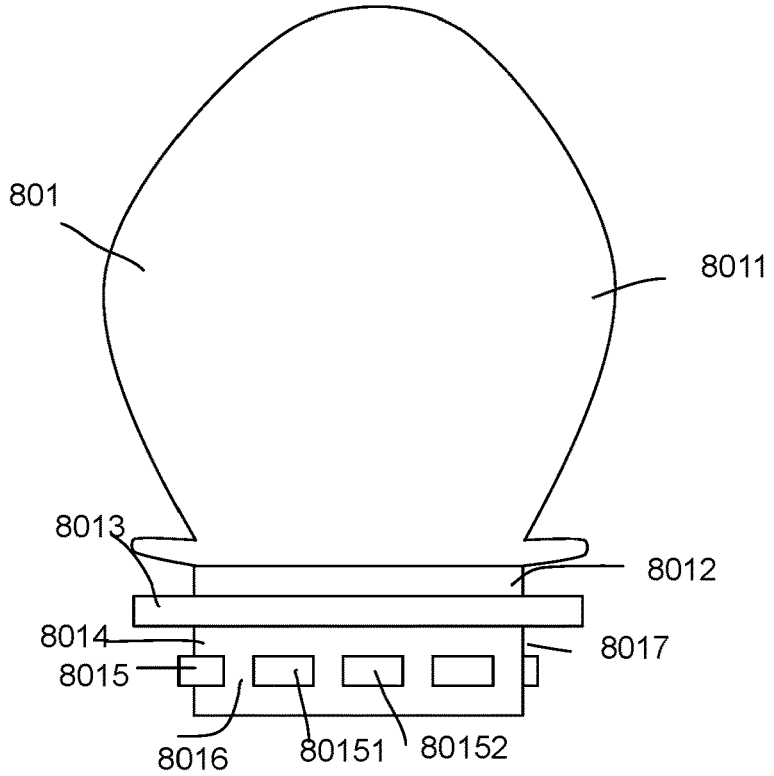
FIG. 8 illustrates a view of a light bulb apparatus in which components not connected.
Figure 8:
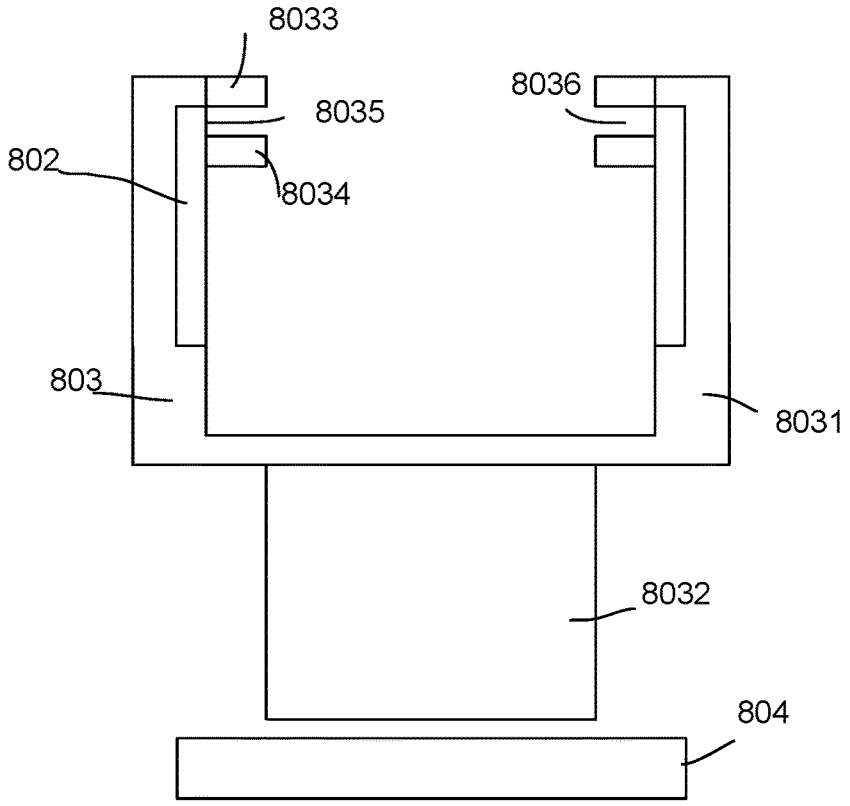

In FIG. 8, a light bulb apparatus includes a bulb shell 801, a bulb head 802 and a light source.

The bulb shell 801 has a light passing portion 8011 and a neck portion 8012. The neck portion 8012 has a first protruding ring 8013, first gap ring 8014 and a second protruding ring 8015. The first gap ring 8014 is located between the first protruding ring 8013 and the second protruding ring 8015 and forming a first concave structure 8017 with respect to the first protruding ring 8013 and the second protruding ring 8015.

The bulb head 803 has a body portion 8031 and a cap portion 8032. The body portion 8031 has a third protruding ring 8033, a second gap ring 8035 and a fourth protruding ring 8034. The second gap ring 8034 is located between the third protruding ring 8033 and the fourth protruding ring 8034 and forms a second concave structure 8036 with respect to the third protruding ring 8033 and the fourth protruding ring 8034. The cap potion 8032 is connected to a power socket 804 for receiving an external power source.

Figure 9:
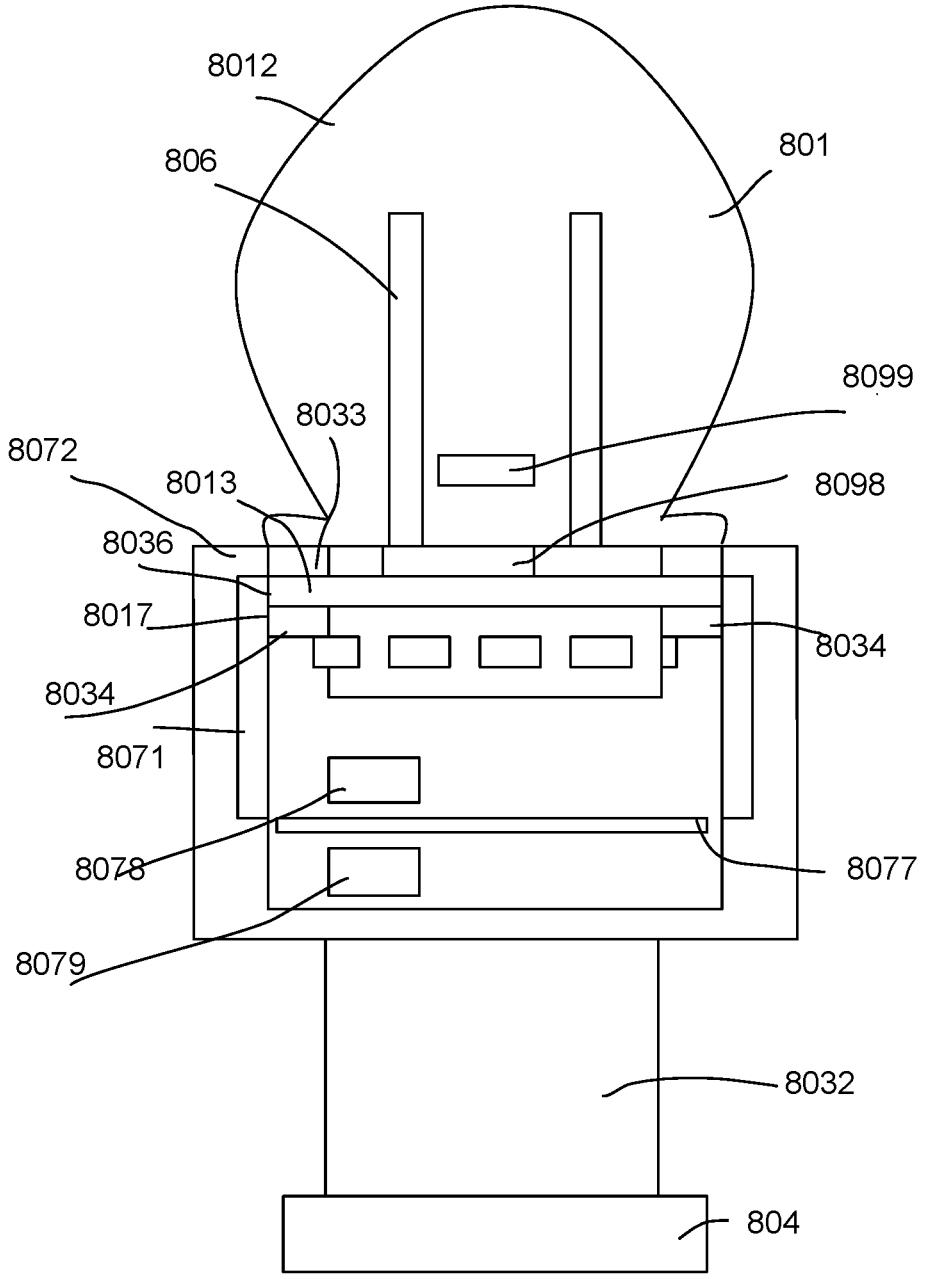
FIG. 9 illustrates an integrated view of the light bulb apparatus.

FIG. 9 shows the assembled light bulb apparatus 8013 of FIG. 8. The first protruding ring 8013 is placed in the second concave structure 8036. The fourth protruding ring 8034 is placed in the first concave structure 8017.

A light source module 806 is enclosed by the bulb shell 801 and emitting light passing through the light passing cover 8011 of the bulb shell 801.

In some embodiments, the first protruding ring is a first closed ring. Specifically, the first protruding ring is a continuous ring with protrusion portion raised from a neighboring area.

The second protruding ring 8015 includes multiple first protruding blocks 80151, 80152, there are first gap areas 8016 between adjacent first protruding blocks.

In some embodiments, the third protruding ring is a second closed ring, the fourth protruding ring includes multiple second protruding blocks, there are second gap areas between adjacent second protruding blocks. This is similar to the first protruding ring and the second protruding ring.

In some embodiments, the multiple first protruding blocks and the multiple second protruding blocks have smaller top portions than bottom portions, the top portions are protruding ends of the multiple first protruding blocks and the multiple second protruding blocks.

Figure 1:
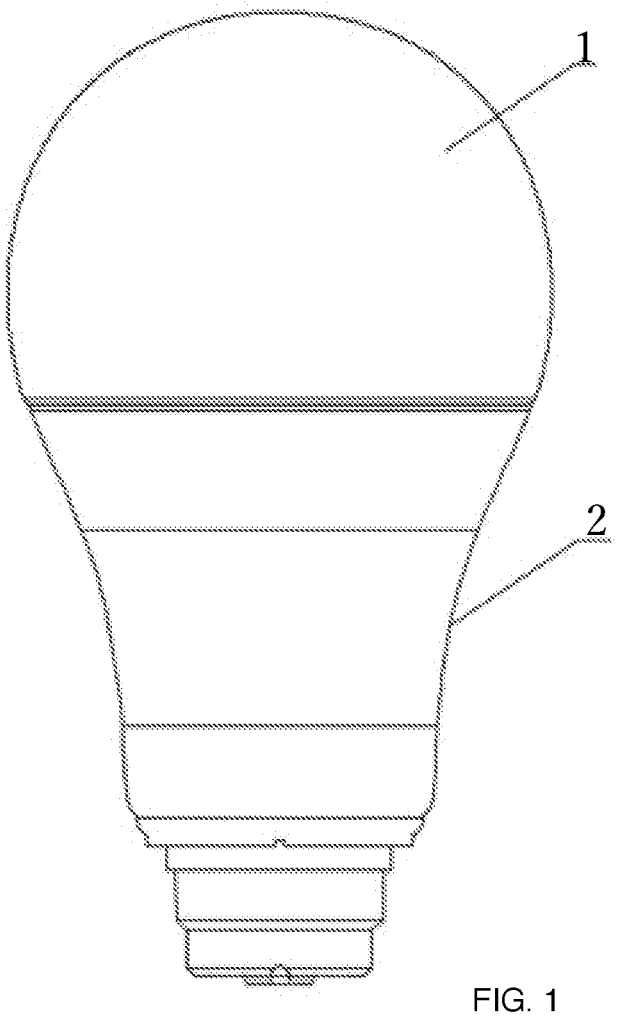
FIG. 1 illustrates a light bulb embodiment.
Figure 2:
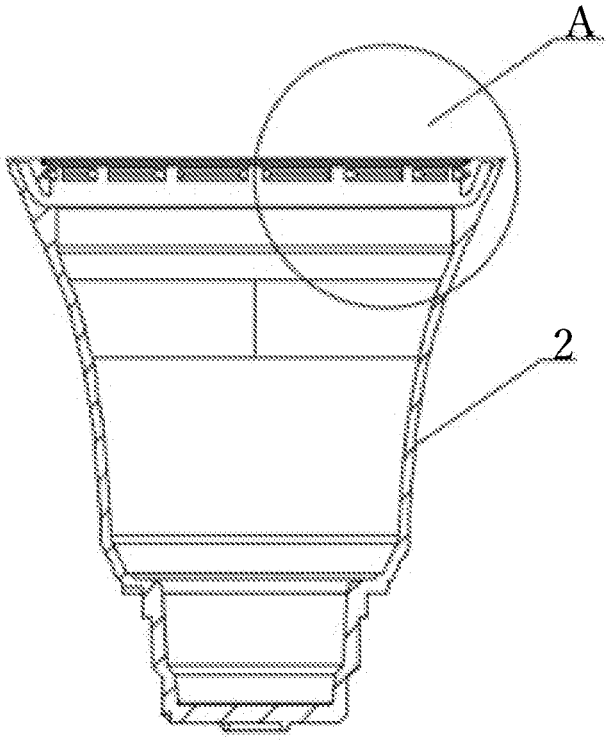
FIG. 2 illustrates a portion of the light bulb embodiment.
Figure 3:
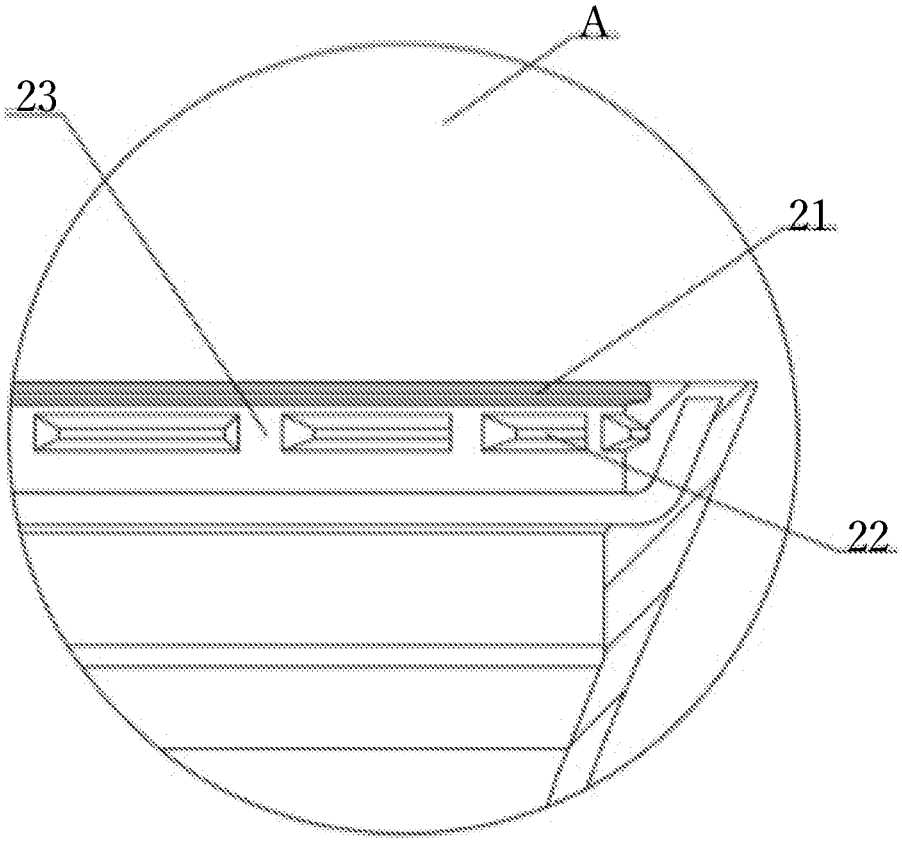
FIG. 3 illustrates an enlarged view of the component in FIG. 2.
Figure 4:
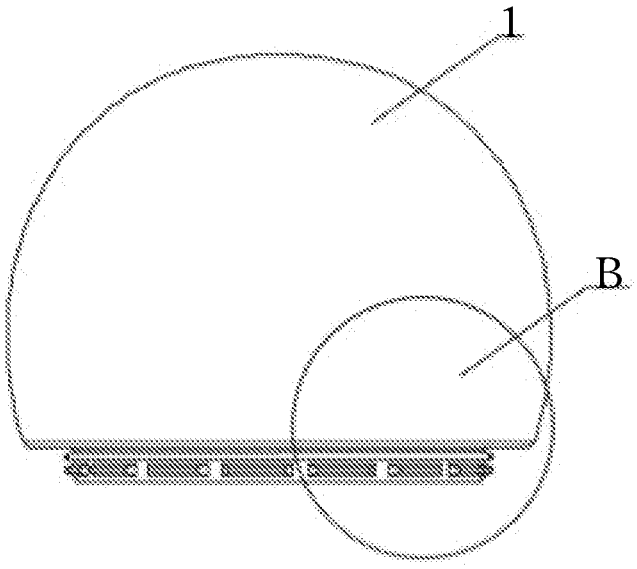
FIG. 4 illustrates a bulb shell example.

In some embodiments, the multiple first protruding blocks and the multiple second protruding blocks are trapezoid shape blocks, e.g. the structures illustrated in FIG. 3.

In some embodiments, the multiple first protruding blocks and the multiple second protruding blocks are triangle blocks.

In some embodiments, the third protruding ring is engaged with the first protruding ring with interference fit connection. The first protruding ring is engaged with the fourth protruding ring with interference fit connection. The fourth protruding ring is engaged with the second protruding ring with interference fit connection.

The interference fit is a form of fastening between two tight fitting mating parts that produces a joint which is held together by friction after the parts are pushed together.

Depending on the amount of interference, parts may be joined using a tap from a hammer or pressed together using a hydraulic ram. Critical components that must not sustain damage during joining may also be frozen to shrink one of the components before fitting. This method allows the components to be joined without force and producing a shrink fit interference when the component returns to normal temperature. Interference fits are commonly used with fasteners to induce compressive stress around holes to improve the fatigue life of a joint.

The tightness of fit is controlled by amount of interference; the allowance (planned difference from nominal size). Formulas exist to compute allowance that will result in various strengths of fit such as loose fit, light interference fit, and interference fit. The value of the allowance depends on which material is being used, how big the parts are, and what degree of tightness is desired. Such values have already been worked out in the past for many standard applications, and they are available to engineers in the form of tables, obviating the need for re-derivation.

As an example, a 10 mm (0.394 in) shaft made of 303 stainless steel will form a tight fit with allowance of 3-10 μm (0.00012-0.00039 in). A slip fit can be formed when the bore diameter is 12-20 μm (0.00047-0.00079 in) wider than the rod; or, if the rod is made 12-20 μm under the given bore diameter.

An example: The allowance per inch of diameter usually ranges from 0.001 to 0.0025 inches (0.0254 to 0.0635 mm) (0.1-0.25%), 0.0015 inches (0.0381 mm) (0.15%) being a fair average. Ordinarily the allowance per inch decreases as the diameter increases; thus the total allowance for a diameter of 2 inches (50.8 mm) might be 0.004 inches (0.1016 mm), 0.2%), whereas for a diameter of 8 inches (203.2 mm) the total allowance might not be over 0.009 or 0.010 inches (0.2286 or 0.2540 mm) i.e., 0.11-0.12%). The parts to be assembled by forced fits are usually made cylindrical, although sometimes they are slightly tapered. Advantages of the taper form are: the possibility of abrasion of the fitted surfaces is reduced; less pressure is required in assembling; and parts are more readily separated when renewal is required. On the other hand, the taper fit is less reliable, because if it loosens, the entire fit is free with but little axial movement. Some lubricant, such as white lead and lard oil mixed to the consistency of paint, should be applied to the pin and bore before assembling, to reduce the tendency toward abrasion.

There are two basic methods for assembling an oversize shaft into an undersized hole, sometimes used in combination: force and thermal expansion or contraction.

The first is using force.

There are at least three different terms used to describe an interference fit created via force: press fit, friction fit, and hydraulic dilation.

Press fit is achieved with presses that can press the parts together with very large amounts of force. The presses are generally hydraulic, although small hand-operated presses (such as arbor presses) may operate by means of the mechanical advantage supplied by a jackscrew or by a gear reduction driving a rack and pinion. The amount of force applied in hydraulic presses may be anything from a few pounds for the tiniest parts to hundreds of tons for the largest parts.

Often the edges of shafts and holes are chamfered (beveled). The chamfer forms a guide for the pressing movement, helping to distribute the force evenly around the circumference of the hole, to allow the compression to occur gradually instead of all at once, thus helping the pressing operation to be smoother, to be more easily controlled, and to require less power (less force at any one instant of time), and to assist in aligning the shaft parallel with the hole it is being pressed into. In the case of train wheelsets the wheels are pressed onto the axles by force.

The second is using thermal expansion or contraction.

Most materials expand when heated and shrink when cooled. Enveloping parts are heated (e.g., with torches or gas ovens) and assembled into position while hot, then allowed to cool and contract back to their former size, except for the compression that results from each interfering with the other. This is also referred to as shrink-fitting. Railroad axles, wheels, and tires are typically assembled in this way. Alternatively, the enveloped part may be cooled before assembly such that it slides easily into its mating part. Upon warming, it expands and interferes. Cooling is often preferable as it is less likely than heating to change material properties, e.g., assembling a hardened gear onto a shaft, where the risk exists of heating the gear too much and drawing its temper.

In some embodiments, the neck portion has a bottom edge engaged with the third protruding ring with interference fit connection.

In FIG. 9, the body portion of the bulb head includes an external layer 8072 and a heat sink layer 8071. The heat sink layer 8071 surrounds the fourth protruding ring 8034 and the heat sink layer 8071 ends near and does not surround the third protruding ring 8033. When the heat sink layer 8071 is rigid metal material like aluminum material, such arrangement makes it easier to deform a portion of the bulb head to insert the bulb shell.

In some embodiments, the connection of the bulb head and the bulb shell relies only by connection friction among the first protruding ring, the second protruding ring, the third protruding ring and the fourth protruding ring without using glue.

Figure 10A:
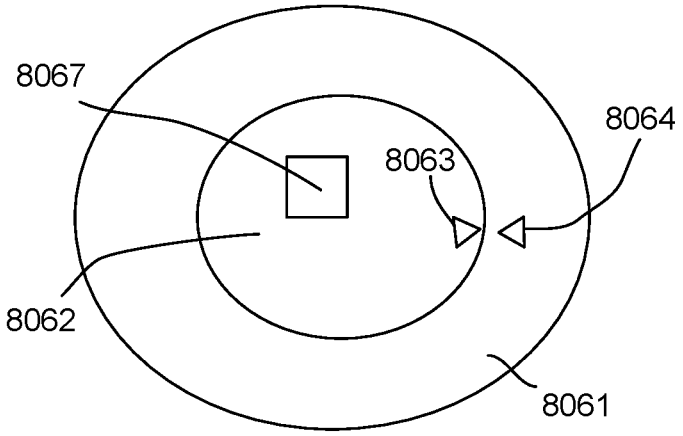
FIG. 10A illustrates an embodiment of a first setting.
Figure 10B:
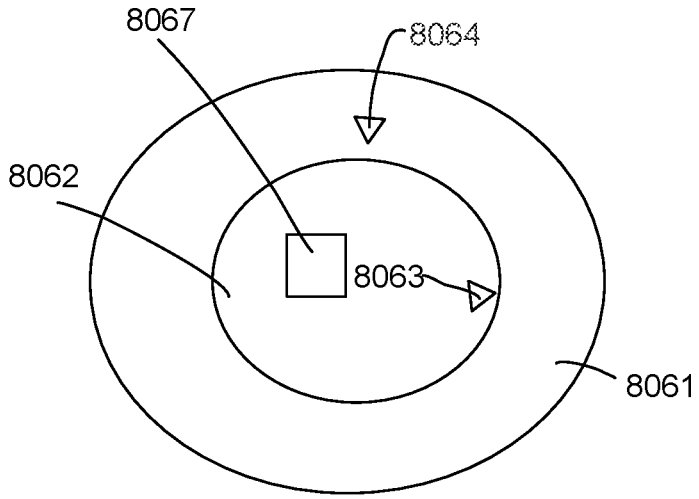
FIG. 10B illustrates the embodiment of a second setting.

In FIG. 10A and FIG. 10B, a light bulb is configured by fixing the bulb head to the bulb shell with a relative angle. In FIG. 10A, a bulb shell 8061 has a first indicator 8064. A bulb head 8062 has a second indicator 8063. By aligning the first indicator 8064 and the second indicator 8063 with a relative angle for choosing a setting. The setting is converted by a resistor or other components to send corresponding messages to a driver 8067 to control the light source module according to the setting. For example, when the first indicator 8064 has 90 degrees with respect to the second indicator 8063, a first color temperature is mixed by the driver 8067 to control different types of LED modules of the light source module. When the first indicator 8064 has 180 degrees with respect to the second indicator 8063, a second color temperature is mixed.

Even the setting is difficult to change, sufficient flexibility is still ensured for lowering overall stocking cost and design complexity.

During manufacturing, a setting is determined according to sales requirements. There are indicator marks on the bulb shell and the bulb head for guiding workers to fix the bulb head to the bulb shell with a relative angle corresponding to the determined setting.

In some embodiments, the setting includes a color temperature mixed by the light source module and is kept the same after the bulb shell is fixed to the bulb head.

In FIG. 9, a heat insulation belt 8098 is disposed on a surface of the body portion for a user to remove the light bulb apparatus from the power socket.

In FIG. 9, a heat insulation belt 8099 is disposed on a surface of the body portion for a user to remove the light bulb apparatus from the power socket.

In some embodiments, a bottom end of the bulb shell engages a heat sink disposed on the bulb head. In FIG. 9, the light passing cover has a blue light decreasing layer 8012 for decreasing blue light emitting outside the bulb shell.

In some embodiments, the blue light decreasing layer includes fluorescent material for converting a blue light to a non-blue light with a lower frequency than the blue light.

In some embodiments, the bulb shell is made of plastic material and deformed when using the bulb shell into the bulb heat to connect the first protruding ring and the second protruding ring.

In FIG. 9, the body portion has a metal surrounding area and a non-metal surrounding area. A current conversion circuit 8078 is placed in the metal surrounding area and a wireless circuit 8079 is placed in the non-metal surrounding area.

In FIG. 9, the metal surrounding area is rotatable with respect to the non-metal surrounding area for manually changing a setting used by a driver to control the light source module according to the setting with a rotation structure 8077.

Please refer to FIG. 1 to FIG. 7.

A lighting apparatus includes a bulb shell 1 and a bulb head 2. An end of the bulb shell 1 facing to the bulb head 2 has a first protruding ring of a ring-shaped first buckle unit and a second protruding ring of an interval distributed second buckle unit.

An end of bulb head 2 facing to the bulb shell 1 has a third protruding ring of a third buckle unit related to the first buckle unit and a fourth protruding ring of a buckle unit related to the second buckle unit.

The bulb shell 1 has two layers of the buckle and is fitted to two layers of the buckle of the bulb head 2. The ring-shaped first buckle unit is fitted to the third buckle unit for preventing an up and down displacement of the bulb shell 1 and the bulb head 2. The interval distributed second buckle unit is fitted to the fourth buckle unit for preventing a left and right displacement of the bulb shell 1 and the bulb head 2, in order to prevent the bulb shell 1 floating up and down and the bulb shell 1 rotating left and right.

A connection of the buckle is relatively low cost, high efficiency less bad products which has solved the problems caused by the traditional gluing process.

In an embodiment, the first buckle unit and the second buckle unit may be protrusions. The third buckle unit and the fourth buckle unit may be concave slots. Between the first buckle unit and the third buckle unit, the second buckle unit and the fourth buckle unit are overlap matching connected.

In an embodiment, the first buckle unit and the second buckle unit may be concave slots. The third buckle unit and the fourth buckle unit may be protrusions. Between the first buckle unit and the third buckle unit, the second buckle unit and the fourth buckle unit are overlap matching connected.

In an embodiment, the protruding lengths of the protrusions may be [1.4 mm, 1.7 mm]. Specifically, if the protruding lengths are too short, the bulb shell 1 may be easily departed from the bulb head 2. If the protruding lengths are too long, the bulb shell 1 may be hard to attach and detach to the bulb head 2. Thus, the protruding lengths may be in the length of 1.4 mm to 1.7 mm for a stable connection and easy attachment and detachment between the bulb shell 1 and the bulb head 2. Furthermore, the width of the protrusion may gradually decrease along the protruding direction. The width of the concave slot may gradually decrease along the concave direction.

From the description above, the concave slot has a guiding function for the protrusion easily connected into the concave slot during installation. Specifically, a side surface of the second buckle unit and a side surface of the fourth buckle unit has a matching tolerance gradually increase along the protruding direction of the second buckle unit. In an embodiment, a side surface of a second protrusion and a side surface of the second concave slot has a matching tolerance gradually increase along the protruding direction. The matching tolerance allows the overlap connection having a changing rate. The side surface of the second protrusion and the side surface of the second concave slot tighter connected through the change increase for preventing the bulb shell 1 subtle rotated.

In an embodiment, the adjacent second protrusions have a first gap between each other and the adjacent fourth buckle unit has a second gap between each other. The first gap and the second gap is matched to each other. The first gap and the second gap may have a better effect on preventing rotation. In an embodiment, a cross-section of the protrusion is trapezoid, triangle or tower-shaped protrusion for a lower cost production.

Specifically, an opened end of the bulb shell 1 closed to the bulb head 2 has a ring-shaped protruding edge. The ring-shaped protruding edge has a side wall conflicted to an inner wall of the bulb head closed to the bulb shell. From the description above, a better technical solution of the connecting methods of the bulb shell and the bulb head is provided. The ring-shaped protruding edge is fixed to the middle of the opened end of the bulb shell and smaller than the size of the opened end for the external wall of the bulb shell and the external wall of the bulb head being on the same curved line for convenient packaging. In an embodiment, the second buckle unit surrounded as a circle. From the description above, a better technical solution of the second buckle unit is provided.

Please refer to FIG. 1 to FIG. 7. In a first embodiment, a lighting apparatus is for all types of light bulb, including LED light bulb. A lighting apparatus include a bulb shell 1 and a bulb head 2. An end of the bulb shell 1 closed to the bulb head 2 has a first buckle unit which is a ring-shaped and a second buckle unit which is interval distributed. An end of the bulb head 2 closed to the bulb shell 1 has a third buckle unit related to the first buckle unit and a fourth buckle unit related to the second buckle unit.

Figure 5:
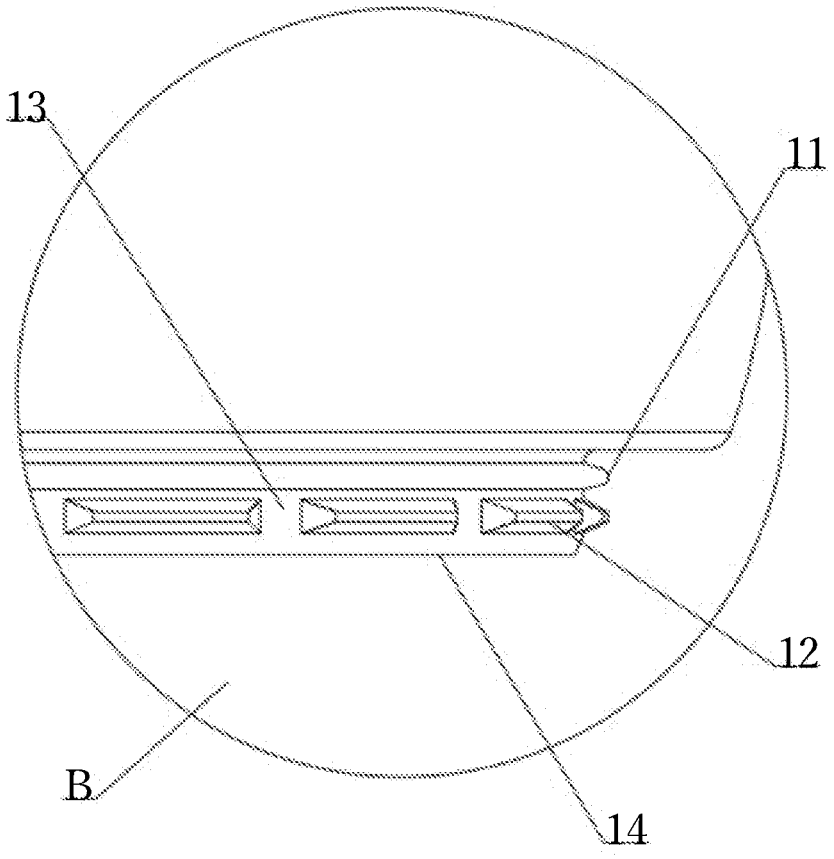
FIG. 5 illustrates an enlarged view of a portion of FIG. 4.
Figure 6:
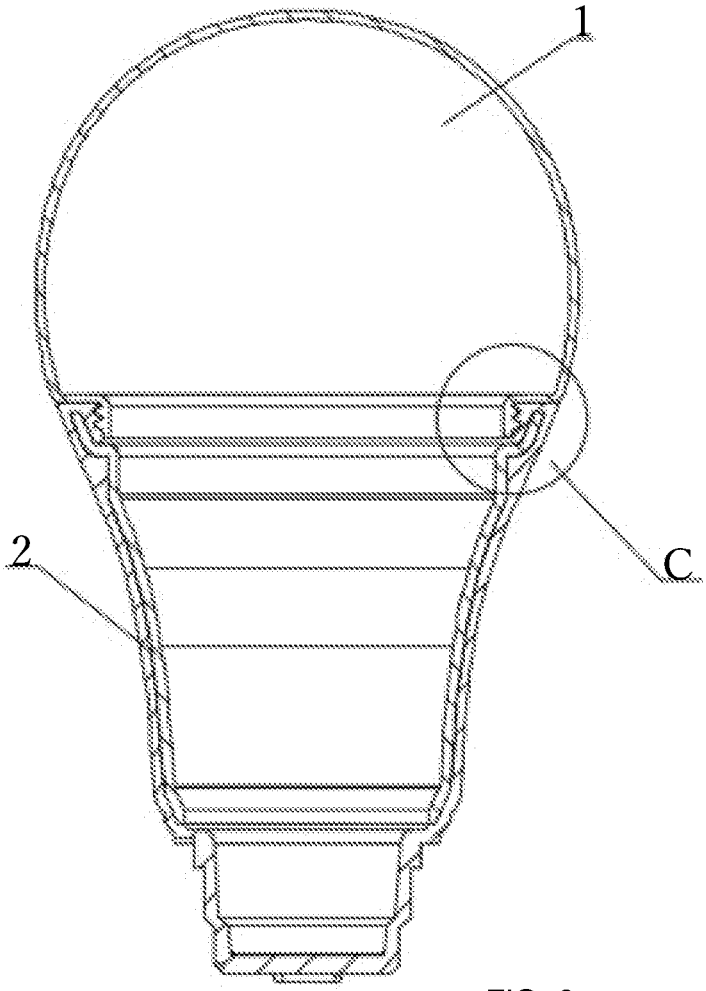
FIG. 6 illustrates a cross sectional view of a bulb apparatus.
Figure 7:
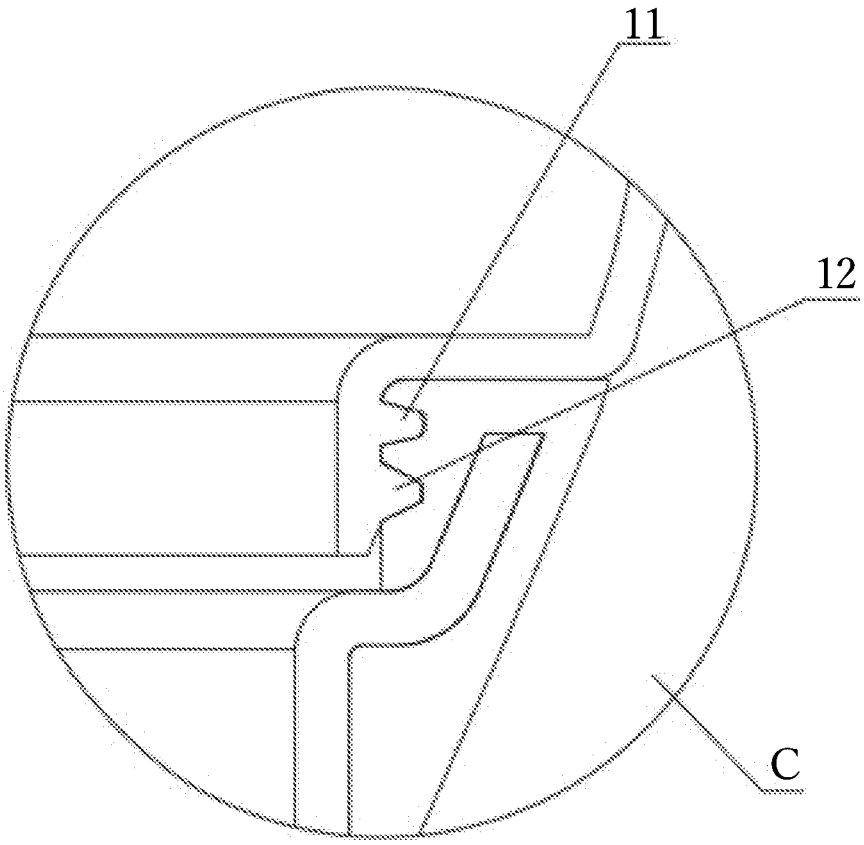
FIG. 7 illustrates an enlarged connection view.

Please refer to FIG. 5. The first buckle unit is a first protrusion 11 and the second buckle unit is a second protrusion 12. Please refer to FIG. 3. The third buckle unit is a first concave slot 21. The fourth buckle is a second concave slot 22. Please refer to FIG. 7. The first protrusion 11 is overlap connected to the first concave slot 21. The second protrusion 12 is overlap connected to the second concave slot. The protruding length of the first protrusion and the second protrusion and the concave depth of the first concave slot 21 and the second concave slot 22 are [1.4 mm, 1.7 mm]. The protruding length of the protrusion and the concave depth of the concave slot is the same. In some embodiment, the concave depth of the concave slot has different protruding length, the protruding length of the first protrusion 11 and the second protrusion 12 or the concave depth of the first concave slot 21 and the second concave slot 22 may not be the same in some embodiments.

Please refer to FIG. 5. The opened end of the bulb shell 1 closed to the bulb head 2 has the ring-shaped protruding edge 14. The first buckle unit and the second buckle unit are surrounded on the external wall of the ring-shaped protruding edge 14. The second buckle unit is interval distributed and forms a circle. The ring-shaped protruding edge 14 is fixed to the middle of the opened end the bulb shell 1 and smaller than the size of the opened end. Please refer to FIG. 7. The external wall of the ring-shaped protruding edge 14 is conflicted to the inner wall of the opened end of the bulb shell 1 closed to the bulb head 2. The external wall of the bulb shell 1 and the external wall of the bulb head 2 is the same curved line.

In an embodiment, the first buckle unit and the second buckle unit may be concave slot. The third buckle unit and the fourth buckle unit may be protrusion. The first buckle unit and the third buckle unit may be a module preventing the bulb shell 1 floating up and down or moving left and right. The second buckle unit and the fourth buckle unit may also be a module preventing the bulb shell 1 floating up and down or moving left and right.

Please refer to FIG. 1 to FIG. 7 for a second embodiment of the lighting apparatus. Please refer to FIG. 7. The cross-section shape of the first protrusion 11 is a tower-shaped. The top of the tower shape is round shape and the bottom is a trapezoid. The cross-section shape of the second protrusion 12 is a trapezoid. The width of the protrusion is gradually decrease along the protruding direction and the width of the concave slot gradually decrease along the concave direction in both the shape of tower and trapezoid.

In an embodiment, a side surface of a second protrusion 12 and a side surface of the second concave slot 22 has a matching tolerance gradually increase along the protruding direction of the second protrusion 12. The adjacent second protrusions 12 has a first gap 13 between each other and the adjacent second concave slot 22 has a second gap 23 between each other. The first gap 13 and the second gap 23 is matched to each other. The first gap and the second gap may have a better effect on preventing rotation. In an embodiment, a cross-section of the protrusion is trapezoid, triangle or tower-shaped protrusion for a lower cost production.

In an embodiment, the bulb shell has two layers of the buckle and is fitted to two layers of the buckle of the bulb head. The ring-shaped first buckle unit is fitted to the third buckle unit for preventing an up and down displacement of the bulb shell and the bulb head. The interval distributed second buckle unit is fitted to the fourth buckle unit for preventing a left and right displacement of the bulb shell and the bulb head, in order to prevent the bulb shell floating up and down and the bulb shell rotating left and right. The matching tolerance between the side surface of the second protrusion and the side surface of the second concave slot are also limited to gradually increase along the second protrusion which provides a fastened connection between the side surface of the second protrusion and the side surface of the second concave slot for preventing the bulb shell subtle rotates, in order to prevent the bulb shell floating up and down and turning left and right. The width of the protrusion gradually decreases along the protruding direction. The width of the concave slot gradually decreases along the concave direction. Thus, the concave slot has a guiding function for the protrusion easily connected into the concave slot during installation. The length of the protrusion is set as [1.4 mm, 1.7 mm] for preventing the bulb shell departed from the bulb head but also convenient to installed and detached for providing an easy detachable lighting apparatus.

During manufacturing, a setting is determined according to sales requirements. There are indicator marks on the bulb shell and the bulb head for guiding workers to fix the bulb head to the bulb shell with a relative angle corresponding to the determined setting.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light bulb apparatus, comprising:

a bulb shell having a light passing portion and a neck portion, the neck portion having a first protruding ring, a first gap ring and a second protruding ring, the first gap ring being located between the first protruding ring and the second protruding ring and forming a first concave structure with respect to the first protruding ring and the second protruding ring;

a bulb head having a body portion and a cap portion, the body portion having a third protruding ring, a second gap ring and a fourth protruding ring, the second gap ring being located between the third protruding ring and the fourth protruding ring and forming a second concave structure with respect to the third protruding ring and the fourth protruding ring, the cap potion being connected to a power socket for receiving an external power source, the first protruding ring being placed in the second concave structure, the fourth protruding ring being placed in the first concave structure; and a light source module enclosed by the bulb shell and emitting light passing through the light passing cover of the bulb shell, wherein the first protruding ring is a first closed ring, the second protruding ring comprises multiple first protruding blocks, there are first gap areas between adjacent first protruding blocks.

2. The light bulb apparatus of claim 1, wherein the third protruding ring is a second closed ring, the fourth protruding ring comprises multiple second protruding blocks, there are second gap areas between adjacent second protruding blocks.

3. The light bulb apparatus of claim 1, wherein the multiple first protruding blocks and the multiple second protruding blocks have smaller top portions than bottom portions, the top portions are protruding ends of the multiple first protruding blocks and the multiple second protruding blocks.

4. The light bulb apparatus of claim 3, wherein the multiple first protruding blocks and the multiple second protruding blocks are trapezoid shape blocks.

5. The light bulb apparatus of claim 3, wherein the multiple first protruding blocks and the multiple second protruding blocks are triangle blocks.

6. The light bulb apparatus of claim 1, wherein the third protruding ring is engaged with the first protruding ring with interference fit connection, the first protruding ring is engaged with the fourth protruding ring with interference fit connection, the fourth protruding ring is engaged with the second protruding ring with interference fit connection.

7. The light bulb apparatus of claim 1, wherein the neck portion has a bottom edge engaged with the third protruding ring with interference fit connection.

8. The light bulb apparatus of claim 1, wherein the body portion of the bulb head comprises an external layer and a heat sink layer, the heat sink layer surrounds the fourth protruding ring and the heat sink layer ends near and does not surround the third protruding ring.

9. The light bulb apparatus of claim 1, wherein the connection of the bulb head and the bulb shell relies only by connection friction among the first protruding ring, the second protruding ring, the third protruding ring and the fourth protruding ring without using glue.

10. The light bulb apparatus of claim 1, wherein a relative angle for fixing the bulb shell to the bulb head determines a setting used by a driver to control the light source module according to the setting.

11. The light bulb apparatus of claim 10, wherein the setting comprises a color temperature mixed by the light source module and is kept the same after the bulb shell is fixed to the bulb head.

12. The light bulb apparatus of claim 1, wherein a heat insulation belt is disposed on a surface of the body portion for a user to remove the light bulb apparatus from the power socket.

13. The light bulb apparatus of claim 1, wherein a heat insulation belt is disposed on a surface of the body portion for a user to remove the light bulb apparatus from the power socket.

14. The light bulb apparatus of claim 1, wherein a bottom end of the bulb shell engages a heat sink disposed on the bulb head.

15. The light bulb apparatus of claim 1, wherein the light passing cover has a blue light decreasing layer for decreasing blue light emitting outside the bulb shell.

16. The light bulb apparatus of claim 15, wherein the blue light decreasing layer comprises fluorescent material for converting a blue light to a non-blue light with a lower frequency than the blue light.

17. The light bulb apparatus of claim 1, wherein the bulb shell is made of plastic material and deformed when using the bulb shell into the bulb heat to connect the first protruding ring and the second protruding ring.

18. The light bulb apparatus of claim 1, wherein the body portion has a metal surrounding area and a non-metal surrounding area, a current conversion circuit is placed in the metal surrounding area and a wireless circuit is placed in the non-metal surrounding area.

19. The light bulb apparatus of claim 18, wherein the metal surrounding area is rotatable with respect to the non-metal surrounding area for manually changing a setting used by a driver to control the light source module according to the setting.

* * * * *